United States Patent [19]

Thompson et al.

[11] 4,339,897

[45] Jul. 20, 1982

[54] SANDBLASTING METHODS AND APPARATUS

[75] Inventors: Robert E. Thompson, Houston; Richard P. McNinney, Richmond, both of Tex.

[73] Assignee: Schmidt Manufacturing, Inc., Houston, Tex.

[21] Appl. No.: 204,345

[22] Filed: Nov. 5, 1980

Related U.S. Application Data

[63] Continuation-in-part of Ser. No. 92,199, Nov. 7, 1979, abandoned.

[51] Int. Cl.[3] ..... B24C 7/00

[52] U.S. Cl. ..... 51/436; 51/438; 51/319; 137/595; 251/5

[58] Field of Search ..... 51/319-321, 51/427, 436, 438; 137/595, 869; 239/586, 373; 251/5

[56] References Cited

U.S. PATENT DOCUMENTS

| | | | |
|---|---|---|---|
| 2,371,434 | 3/1945 | Eppler | 51/438 |
| 3,028,878 | 4/1962 | Natho | 137/869 X |
| 3,759,483 | 9/1973 | Baxter | 251/5 |
| 3,793,785 | 2/1974 | Austin | 51/436 |
| 3,834,082 | 9/1974 | Gruozinski | 51/436 |
| 4,075,789 | 2/1978 | Dremann | 51/438 X |

FOREIGN PATENT DOCUMENTS

| | | | |
|---|---|---|---|
| 565260 | 2/1944 | United Kingdom | 51/438 |

*Primary Examiner*—James G. Smith
*Attorney, Agent, or Firm*—Carl B. Fox, Jr.

[57] ABSTRACT

Sandblasting apparatus and valve apparatus therefor, and methods for performing sandblasting operations, wherein an abrasive-filled pressure vessel is pressured by sandblast air when an air control valve is opened, and wherein automatic blowdown of the pressure within the pressure vessel is required when the air control valve is closed, a dual valve structure being provided in which the air control valve and blowdown control valve are combined and in which the two valves operate in tandem, one valve being open when the other is closed.

34 Claims, 9 Drawing Figures

SANDBLASTING METHODS AND APPARATUS

This application is a continuation-in-part of application Ser. No. 92,199, filed Nov. 7, 1979, now abandoned.

BACKGROUND OF THE INVENTION

Sandblasting is performed by injecting sand or other abrasive particulate material into a compressed air stream which expands to atmospheric pressure through a nozzle, hurling the abrasive material against a target at high velocity.

One common method for introducing abrasive into the air stream is to store the abrasive in a container which is pressurized to the same pressure as the air stream, and allowing the abrasive to enter the air stream under the influence of gravity, preferably through a metering device. Current OSHA regulations require that the blasting cycle, that is, on-off control of the air-abrasive stream, be controlled by the operator at the nozzle with some type of "deadman" control. In other words, the blasting function is required to be automatic.

On larger units, the pressure vessel is constantly maintained under pressure, and the sandblast air is cycled on and off either in conjunction with an abrasive metering valve or is controlled with a guillotine type valve. On smaller units, the entire pressure vessel is pressurized and de-pressurized with each sandblasting cycle, allowing continuous filling of the unit through a poppet-type valve, and requiring an automatic valve to de-pressurize the pressure vessel. This latter type of sandblasting unit is the type for which the invention is designed.

Since the pressure vessels used to contain sand or other abrasive material with this type of sandblasting unit are relatively small, when the pressure vessel is de-pressurized through a blowdown valve a great deal of abrasive is carried through the blowdown valve, causing frequent valve failure resulting from internal abrasion of the valve. Blowdown valves have been protected by the use of various filters, traps, strainers, and the like, none of which has proved satisfactorily effective, either because of design limitations resulting from the fact that at least some dust will pass through the blowdown valve with the air, or because of user neglect and/or abuse. Many types of valves have been tried in this service, with only limited success.

Since sandblast hose is especially designed to carry the abrasive or aggressive air-sand mixture, a guillotine type valve should produce the most reliable service, and should also eliminate the need for a filter or strainer for protection of the blowdown valve. For these reasons, the apparatuses provided by this invention incorporate a blowdown valve of the guillotine type. Automatic control of sandblasting requires that the air control valve which controls air introduction to the sandblast hose and the blowdown valve which controls air exhaust from the pressure vessel must be operated so that one of these valves is closed when the other is opened. A double valve, that is, a valve structure which includes two valves, one for air control and the other for blowdown control, meets this requirement. Consideration of and experimentation with different valve type combinations has resulted in the designs presented by the present invention, each of which includes a rolling diaphragm or piston actuated air valve and a guillotine type blowdown valve. The double valve apparatuses, together with their methods of operation, solve many of the problems heretofore encountered in sandblasting methods and apparatuses, and provide improved and more reliable service as compared with heretofore known methods and apparatuses.

SUMMARY OF THE INVENTION

The invention provides sandblasting apparatus in several forms which include a double or combination valve in which one valve controls air flow into the sandblasting hose and another valve controls pressure vessel blowdown air flow, the air flow valve being opened when the blowdown valve is closed, and vise versa. A diaphragm or piston actuated valve is used to control air flow to the sandblast hose. A guillotine type valve is used to control flow of blowdown air. The guillotine type valve used for blowdown control is operated by pinching an elastomeric hose between a fixed transverse bar and a movable transverse bar, and the elastomeric property of the hose is utilized to provide a spring action for operation of the diaphragm actuated valve. The valve which controls air flow to the sandblast hose includes either a BELLOFRAM rolling diaphragm actuator or a piston actuator, the air flow control valve being a three-way valve in its function. The BELLOFRAM rolling diaphragm is a shaped, generally circular, diaphragm having a peripheral portion around its outer edge for use in forming a seal around the diaphragm, and having circular plates at its opposite sides at its central portion so that the central portion of the diaphragm moves as a unit, the annular portion outward from the circular plates to the surrounding sealing bead flexing between a U-shaped cross section and a straight cross section upon diaphragm movement. Compressed air from the compressed air source supplied to the air control valve is delivered through a tube or hose to a deadman valve device which supplies compressed air through another hose or tube to the diaphragm or piston chamber when a control lever of the deadman valve is depressed to open the air control valve. The deadman valve device, well known in the art, when actuated opens for air flow therethrough to the device to be controlled, such air flow being stopped when the deadman device is not actuated.

The apparatus and its method of operation provide positive sandblast air control and positive pressure vessel blowdown control for sandblast operations. The guillotine type blowdown valve is exceedingly resistant to abrasive wear and is capable of very long satisfactory service. The air supply valve is maintained positively closed when the deadman device is not actuated, and is not subject to accidential opening. For these and other reasons, the apparatus and methods according to the invention provide a significant improvement over the apparatuses and methods known in the prior art.

A principal object of the invention is to provide improved sandblasting methods and apparatuses. Another object of the invention is to provide such methods and apparatuses wherein sandblast air control and pressure blowdown control are provided by a single combination apparatus. A further object of the invention is to provide such methods and apparatus wherein blowdown is provided through an elastomeric hose or tube forming the flowway of a blowdown valve whereby abrasion of non-elastic parts is avoided. Yet another object of the invention is to provide such apparatus wherein the resiliency of the blowdown valve hose provides spring action used in operation of the air supply valve. A still further object of the invention is to provide apparatus which is fail-safe. A further object of the invention is to provide such methods and apparatus which are economical and yet which are entirely reliable and dependable in use.

Other objects and advantages of the invention will appear from the following detailed description thereof, reference being made to the accompanying drawings.

BRIEF DESCRIPTIONS OF THE DRAWINGS

DESCRIPTIONS OF THE PREFERRED EMBODIMENTS

Figure 1:
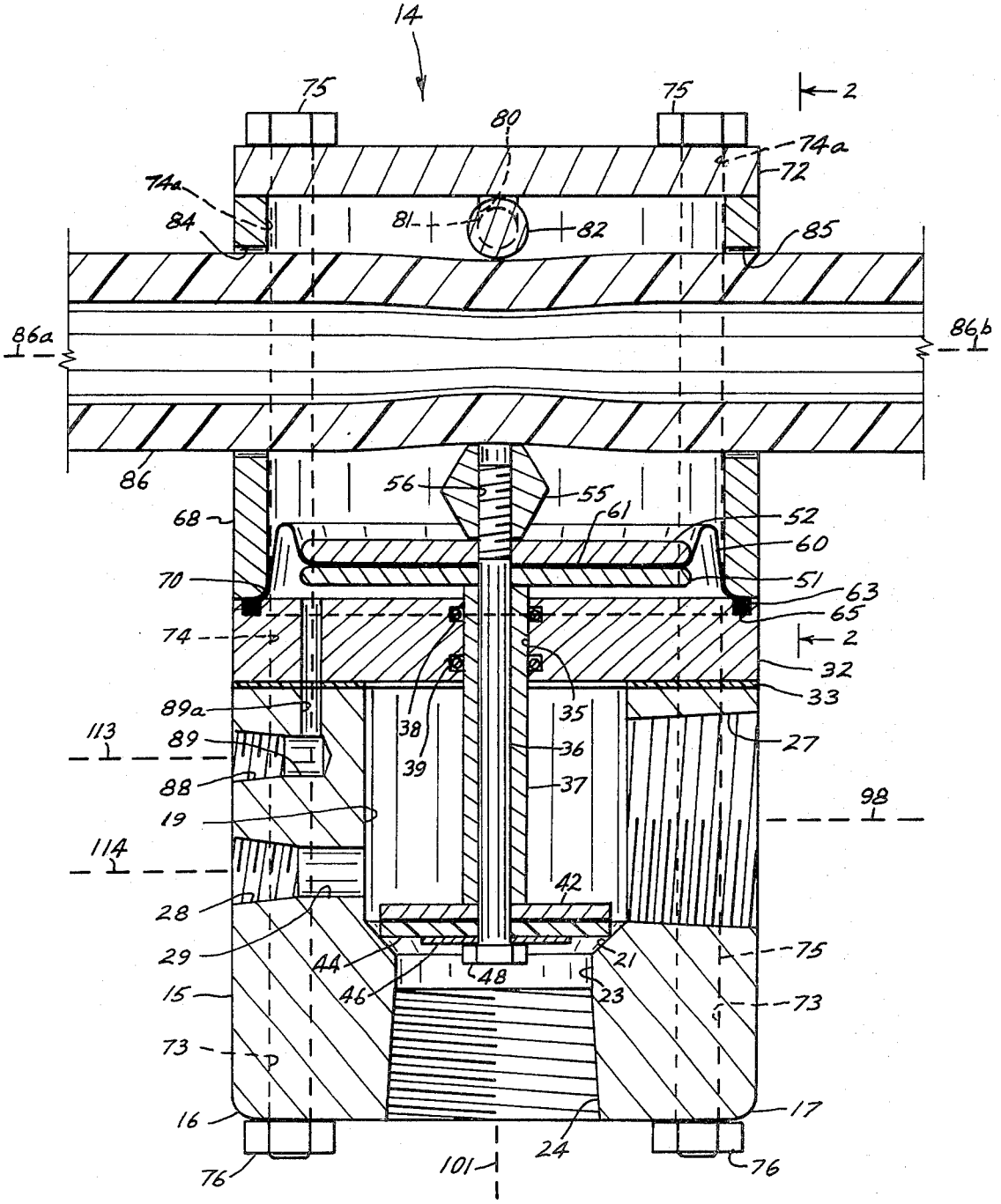
FIG. 1 is a vertical cross section of a preferred embodiment of apparatus according to the invention and illustrative of the methods of the invention.
Figure 2:
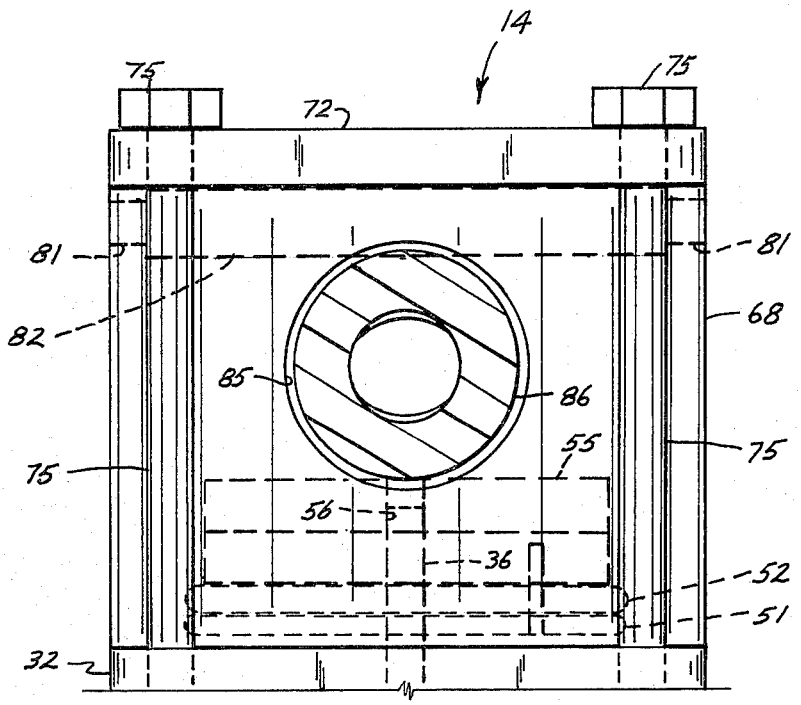
FIG. 2 is a side elevation taken at line 2—2 of FIG. 1.

Describing the preferred embodiments of the invention in detail, and referring first to FIGS. 1 and 2 of the drawings, the novel double or dual valve apparatus 14 according to the invention includes a valve body 15, which is of square horizontal cross section, and which has rounded edges as at 16, 17 at its vertical and lower edges. A cylindrical chamber 19 having its vertical axis at the center of body 15 terminates downwardly at downwardly convergent conical seat surface 21, below which cylindrical passage 23 and threaded socket 24 are provided. Threaded socket 27 communicates with cylindrical opening 19 from the exterior of body 15 at one side thereof, while smaller threaded socket 28 and cylindrical passage 29 communicate with opening 19 at the opposite side of body 15.

A plate 32 of the same outwardly squared form as body 15 is disposed against the upper side of body 15 to close the upper end of cylindrical opening 19. Gasket 33 seals between body 15 and plate 32. Plate 32 has a central cylindrical passage 35 therethrough through which an elongate screw 36 surrounded by tubular sleeve 37 are closely fitted and sealed by O-ring seals 38, 39, or other suitable seals. Circular valve plate 42 has a central opening closely fitted about screw 36 at the lower end of sleeve 37, and elastomeric valve disc 44 of the same size as plate 42 is similarly fitted about screw 36 below plate 42. A washer 46 is disposed about screw 36 below disc 44 and bears against the upper side of head 48 of screw 36. The surrounding edge of valve disc 44 may be closed against conical seat 21, as shown in FIG. 1 of the drawings, or may be moved away from seat 21.

At the upper end of sleeve 37, circular disc-shaped members 51 and 52 have central openings adapted to receive screws 36 therethrough, and a bar member 55 of hexagonal cross sectional has a tapped opening 56 at its longitudinal center into which the upper end of screw 36 is screwed. Members 51, 52 have semicircularly rounded edges, as shown.

A diaphragm 60 of generally circular form has a central flat circular portion 61 sandwiched between disc-shaped members 51, 52, a central opening receiving screw 36 through the diaphragm. A thickened bead 63 is formed around the outer edge of diaphragm 60. Between its central circular portion 61 and bead 63, an annular portion of diaphragm 60 is shaped in rollable bellows form, as shown in FIG. 1, whereby the central portion 61 of the bellows may be moved upwardly and downwardly with respect to surrounding bead 63, the annular bellows portion being moved between a straight form and the curved form shown. Outer bead portion 63 of the bellows is disposed within a concentric circular groove 65 formed around the upper side of plate 32. A cylindrical tubular body member 68 is disposed with its lower end against the upper side of plate 32, and bears against circular bead formation 63 to form a seal between the lower end of body 68 and plate 32. The inner edge of the lower end of body 68 is rounded at 70 so that bellows 60 is not disposed against a sharp edge of body 68.

An upper plate 72 of the same squared shape as members 15 and 32 is disposed against the upper end of tubular member 68, as best shown in FIGS. 1 and 2.

Body 15, plate 32, and plate 72 have aligned cylindrical openings 73, 74, 74*a* adjacent their corners through which four elongate bolts 75 extend. Each of the bolts 75 has a nut 76 screwed onto its lower end. The bolts 75 hold elements 15, 32, 68 and 72 securely together, the inner sides of bolts 75 being disposed against the outer surface of tubular member 68 whereby tubular member 68 is maintained in a fixed aligned position centered with respect to body 15 and plate 32.

Tubular member 68 has two U-shaped slots 80 at opposite sides of its upper end adapted to receive the reduced ends 81 of a cylindrical bar 82. Bar 82 is retained in place with its ends in U-slots 80 by the top plate 72. Bar 82 is disposed parallely above hexagonal bar 55.

Tubular member 68 has oppositely disposed circular openings 84, 85 therethrough to receive an elastomeric hose or tube 86, hose 86 being disposed perpendicular to bars 55, 82.

Body 15 has a threaded socket 88 terminating inwardly in a cylindrical passage 89. A passage 89*a* is provided vertically through body 15, plate 32, and gasket 33 to communicate between passage 89 and the space above plate 32 beneath diaphragm 60. Introduction of pressured air or other gas through passages 89 and 89*a* to beneath the diaphragm 60 will cause movement of diaphragm 60 upwardly, members 51, 52 moving therewith, to move screw 36 upwardly whereby valve disc 44 is moved away from seat 21 to open flow communication between threaded passages 24 and 27. At the same time, the opening movement of the lower valve moves hexagonal bar 55 upwardly against hose 86 to pinch hose 86 between hexagonal bar 55 and bar 82. Therefore, when the lower valve within body 15 is opened, the hose 86 is closed. Conversely, when hose 86 is opened because of a downward position of hexagonal bar 55, then valve disc 44 will be seated against seat 21 to close the lower valve within body 15. The flow direction through hose 86 is indicated by arrows 86*a*, 86*b* in FIG. 1, but the flow could as well be in the opposite direction. Closing of valve disc 44 is assisted by the spring-like characteristic of hose 86. Hose 86, being elastomeric, is biased toward a cylindical tubular configuration whereby when an elevated air or gas pressure is not imposed beneath diaphragm 60, the elastomeric nature of hose 86 will cause a downward force on hexagonal bar 55 which moves screw 36 and valve disc 44 downwardly to closed position. Blowdown gas pressure within hose 86 will also cause the hose to revert to a rounded condition.

Figure 3:
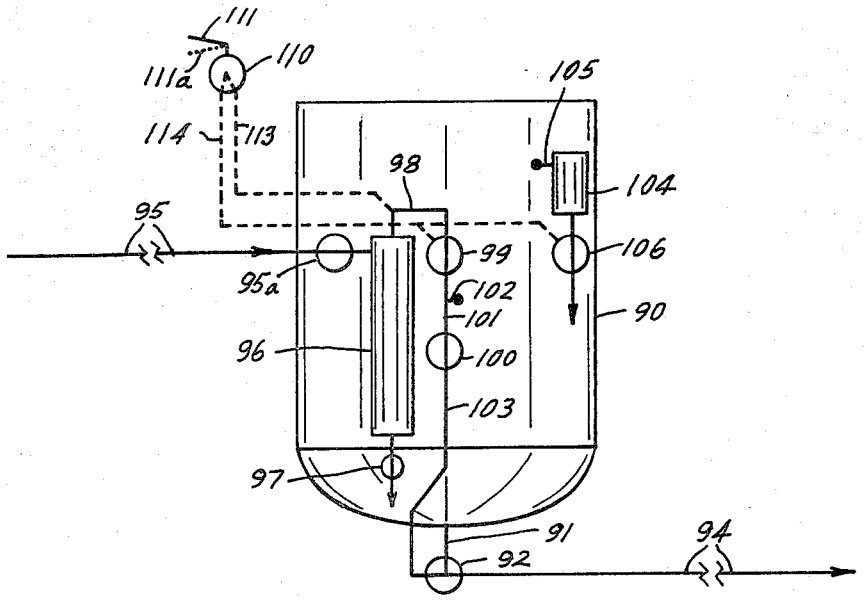
FIG. 3 is a schematic drawing showing a prior art method and apparatus.

FIG. 3 of the drawings schematically shows a conventional sandblasting system. A pressure vessel 90 contains sand or another abrasive which may be delivered through conduit 91 to an abrasive metering valve 92 adapted to deliver a measured rate of sand to be mixed with compressed air traveling through a sandblasting hose 94. The sandblast air is delivered from a suitable source to the system through a conduit 95 connected to a moisture trap 96. A manual valve 95*a* is provided in conduit 95. Water entrapped in trap 96 may be removed as necessary through petcock 97. Dewatered air flows from trap 96 through conduit 98 to an automatic air valve 99, from which the air flows through conduit 101, choke valve 100, and conduit 103 to a connection to the sand metering valve 92 and sandblast hose 94. Air also flows into pressure vessel 90 through connection 102. With the system pressured, the interior of vessel 90 will be at the same pressure as the pressure of the sandblast air delivered to the sandblast hose 94.

Abrasive trap 104 has communication with the interior of pressure vessel 90 through conduit 105. When pressure is to be relieved within vessel 90, blowdown valve 106 is opened, and air within vessel 90 flows out through conduit 105, abrasive trap 104, and blowdown valve 106. Because of OSHA requirements, blowdown valve 106 must be automatically opened to relieve air pressure within vessel 90 whenever automatic air valve 99 is closed.

The automatic control of the valves must be performable by the sandblast operator who is handling the sandblast hose 94 during the sandblasting operation. For this purpose, a deadman valve 110 having control lever 111 is provided at the end of the sandblast hose where the sandblasting stream issues from the sandblast nozzle. Although not so shown in the drawings, deadman valve 110 is located at the end of hose 94. The structure of deadman valve 110 is not shown in the drawings, but is well known in the art. When control lever 111 is depressed to position 111*a*, compressed air delivered from conduit 98 through hose 114 is allowed to flow through hose 113 to open air valve 99 and to close the blowdown valve 106. When lever 111 is released, air pressure within hose 113 is vented at the deadman valve 110, causing closing of automatic air valve 99 and opening of blowdown valve 106. Therefore, whenever air is allowed to flow through automatic air valve 99, the vessel 90 is internally pressured with the blowdown valve 106 closed. When automatic air valve 99 is closed, blowdown valve 106 is opened whereby the internal pressure within vessel 90 is released. As stated earlier, the system of FIG. 3 is conventional and forms no part of the present invention. FIG. 3 is presented for comparison with the novel system according to the invention.

Figure 4:
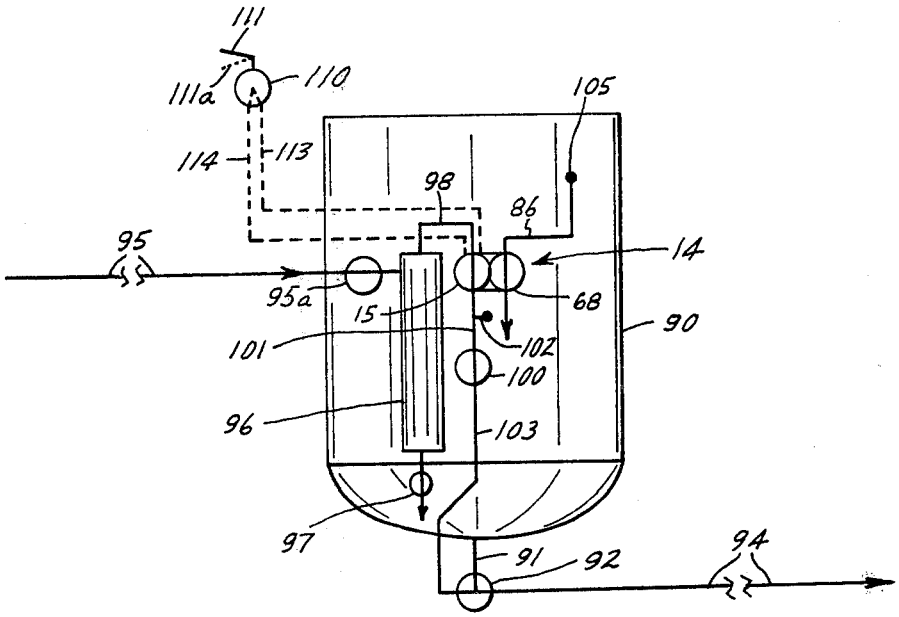
FIG. 4 is a schematic drawing illustrating the method of the invention.

Referring now to FIG. 4 of the drawings, schematically showing the methods and apparatus according to the invention, the pressure vessel 90 is equipped with the moisture trap 96 having petcock 97. The abrasive trap 104, as in FIG. 3, is not needed and is preferably omitted. Conduit 91, sand metering valve 92, and sandblast hose 94 having a sand blast nozzle and deadman 110 and its end are provided as in FIG. 3. Air inlet conduit or hose 95 controlled by manual valve 95*a* and leading to moisture trap 96 are provided, as before.

However, instead of automatic air valve 99 and blowdown valve 106 being separately provided as in the conventional equipment, the functions of these two valves are provided by the dual valve assembly 14 shown in FIGS. 1 and 2 of the drawings, or by one of the other dual valve assemblies shown in FIGS. 5–9 of the drawings. The main body parts 15 and 68 of dual valve 14 are indicated by their respective reference numberals in FIG. 4. Referring to FIG. 1, air supply conduit 98 leading from moisture trap 96 is connected to threaded socket 27 of body 15. Threaded socket 24 of body 15 is connected to the conduit 101 leading to choke valve 100. Conduit 102 is provided whereby when valve disc 44 is opened away from seat 21, air will be introduced into vessel 90. Outlet 105 of the pressure vessel is connected to hose 86 extending through openings 84, 85 of sleeve number 68. The lower valve of the FIGS. 1–2 assembly, in body 15, therefore serves the function of the automatic air inlet valve 99 of FIG. 3, while the upper valve assembly of FIGS. 1–2, within sleeve member 68, serves the function of the blowdown valve 106 of FIG. 3. The OSHA requirements are fully satisfied by the valve structure described herein and presented in FIGS. 1 and 2 of the drawings, connected into a sandblast unit as shown in FIG. 4.

Hose 114 leading to deadman valve 110 is connected to threaded socket 28 of body 15, while hose 113 is connected to threaded socket 88 of body 15. Pressured air is always supplied to the deadman valve so long as manual control valve 95*a* in air supply conduit 95 is open. When lever 111 of deadman valve 110 is depressed to its position 111*a*, pressured air is supplied through conduit 113 to expand diaphragm 60, this causing opening of valve disc 44 and simultaneously causing pinching off of hose 86 between bars 55 and 82, closing blowdown from vessel 90. When lever 111 is released, air pressure beneath diaphragm 60 is released at the deadman valve whereby the elasticity of hose 86 supplemented by air pressure within the hose causes closing of valve disc 44 against seat 21 with simultaneous opening of hose 86 to provide blowdown from vessel 90.

The apparatus is fail-safe. Whenever control lever 111 is released, air pressure below bellows 60 is relieved, so that valve disc 44 becomes closed at seat 21. Air entering chamber 19 through conduit 98 assists in closing valve disc 44 at seat 21, and the valve will remain closed until such time as pressured air is again admitted to expand diaphragm 60. Closing of valve disc 44 at seat 21 will occur in the event that either control hose 113, 114 becomes cut or ruptured, or in the event of failure of the compressed air supply, and pressure within vessel 90 will automatically be relieved.

Five alternative forms of dual valves are shown in FIGS. 5–9 of the drawings. In each of FIGS. 5–9, the lower body portion 15 of the dual valve assembly is the same as shown in FIGS. 1 and 2.

Figure 5:
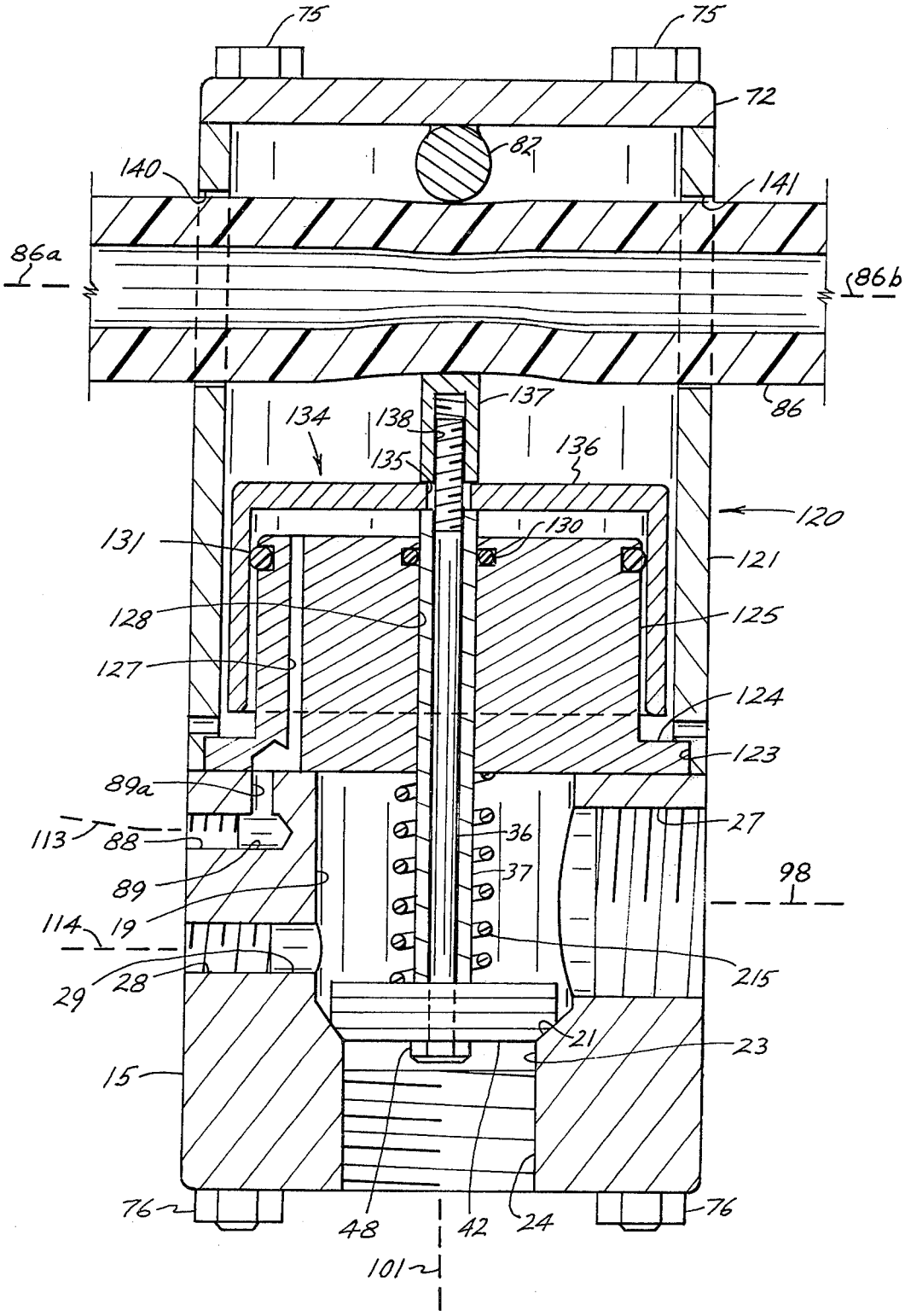
FIG. 5 is a vertical cross section of another preferred embodiment of apparatus according to the invention.

In the FIG. 5 embodiment of the apparatus 120, vertically disposed cylindrical sleeve 121 is engaged at its lower end against the upper surface of body 15. Sleeve 121 is inwardly annularly recessed at 123, and flange 124 of cylindrical body 125 is received in recess 123. Body 125 has a passage 127 vertically therethrough which communicates with passage 89*a* of body 15. Central passage 128 of body 125 is of circular cross section, and sleeve 37 and shaft 36 are closely disposed therethrough. O-ring seal 130 disposed in an annular recess about passage 128 forms a seal between the wall of passage 128 and sleeve 37. O-ring seal 131 is disposed in an annular recess around the exterior of body 125 and seals between body 125 and the interior of cup-shaped piston 134.

Cylindrical opening 135 of piston 134 has shaft 36 disposed therethrough, the upper end of sleeve 37 engaging the lower side of top plate portion 136 of piston 134. A transverse bar 137 has a tapped opening 138 which is screwed onto the threaded upper end of shaft 36. Top plate portion 136 of piston 134 is clamped between bar 137 and the upper end of sleeve 37, as shown. Sleeve 121 has openings 140, 141, preferably circular, through which elastomeric blowdown conduit or hose 86 is disposed. Top plate 72 having transverse bar 82 welded or otherwise affixed to its lower side is generally square-shaped and is engaged across the upper opening of sleeve 121, being fixed in place by the bolts 75 and nuts 76 disposed at the corners of plate 72. Bolts 75, extending past the outer surface of sleeve 121, hold sleeve 121 in centered position with respect to lower body portion 15 of the apparatus.

The operation of dual valve 120 of FIG. 5 is substantially identical with the operation described for the FIGS. 1–2 embodiment. When pressurized sandblast air enters chamber 19 from conduit 98, and when the deadman control valve is operated, pressured air entering through passages 89, 89*a*, and 127 forces piston 134 to move upward so that blowdown hose 86 is closed between transverse bars 82 and 137. Valve 42 is opened so that the sandblast air passes out of passage 124 to sandblast hose 101. Upon release of the deadman control valve, pressure within passages 89, 89*a*, 127 is reduced to atmospheric, and pressure within the blowdown hose and the resiliency of the hose, together with the pressure within chamber 119, cause closing of valve 42 and opening of the blowdown hose.

Figure 6:
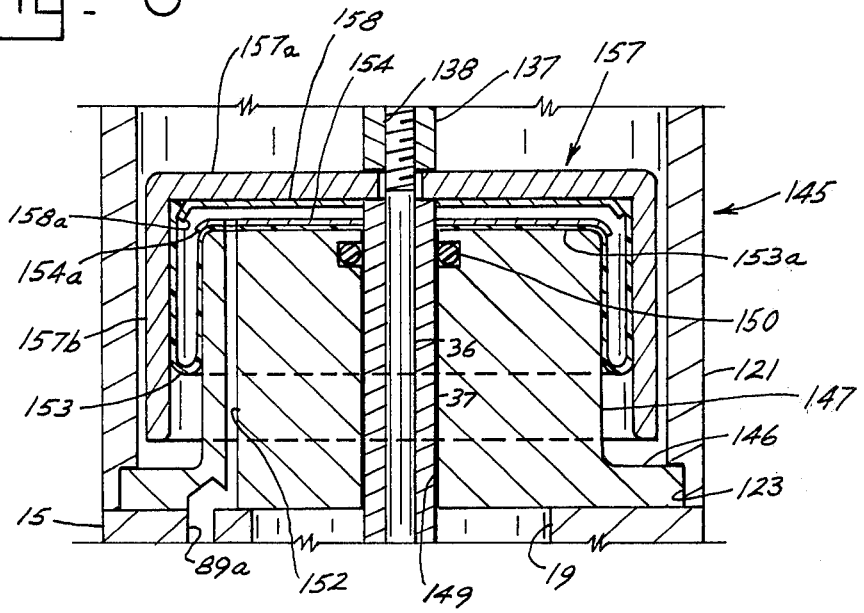
FIGS. 6–9 are partial vertical cross sections showing additional modified forms of apparatuses according to the invention.

Referring now to the apparatus 145 shown in FIG. 6 of the drawings, lower body member 15 is the same as has already been described, and is only partially shown. The portion of apparatus 145 above what is shown in FIG. 6 is the same as heretofore described. Sleeve 121 has annular interior recess 123 around its lower end. Flange 146 of body 147 has its outer portion disposed in recess 123, and is clamped against the upper side of body 15 by the bolts 75 and nuts 76, as before. Body 147 has passage 149 of circular cross section through which shaft 36 and sleeve 37 are disposed, a seal around sleeve 37 being formed by O-ring seal 150 disposed in an annular recess around passage 149.

Passage 152 vertically through body 147 communicates at its lower end with passage 89*a* of body 15, and extends through diaphragm 153 and diaphragm retaining plate 154. Circular plate 154 is disposed over a circular central portion 153*a* of diaphragm 153 which is disposed over the top of body 147, and plate 154 has downwardly curved edge portion 154*a* which bends diaphragm 153 downwardly around the rounded upper edge of body 147.

Diaphragm 153 extends downwardly along the vertical sides of body 147 and then curves outwardly and upwardly along the inner vertical surface of cup-shaped body 157. Plate 158 is fixed against the underside of top plate portion 157*a* of body 157, and has downturned edge portion 158*a* therearound, the thickened peripheral edge of the diaphragm being clamped between the edge portion 158*a* of plate 158 and the vertical wall portion 157*b* of body 157, as shown. The vertical wall portion 157*b* is in the form of a downwardly extending circular skirt around the edge of circular top plate portion 157*a*. Diaphragm 153, plate 154, and plate 158 each has a circular opening at its center through which shaft 36 and sleeve 37 extend. Plate 158 is held in place against the underside of top plate portion 157*a* of body 157 by being tightly fitted around the upper end of sleeve 37.

Bar 137, as before, has tapped opening 138 which is screwed onto the upper threaded ended of shaft 36, and serves the same function in the closing of the blowdown hose 86 as was described in connection with the FIG. 5 embodiment.

When pressured air is supplied from the deadman control valve to passages 89*a* and 152 to above plate 154, the space between plates 154, 158 is expanded so that body 157 is moved upwardly to close the blowdown hose. Shaft 36 and sleeve 37 are moved upwardly to cause opening of valve 42. Closing of the deadman control valve reduces the pressure above plate 154 so that the blowdown hose is opened and valve 42 is closed, in the same manner as has been described for the other embodiments.

Figure 7:
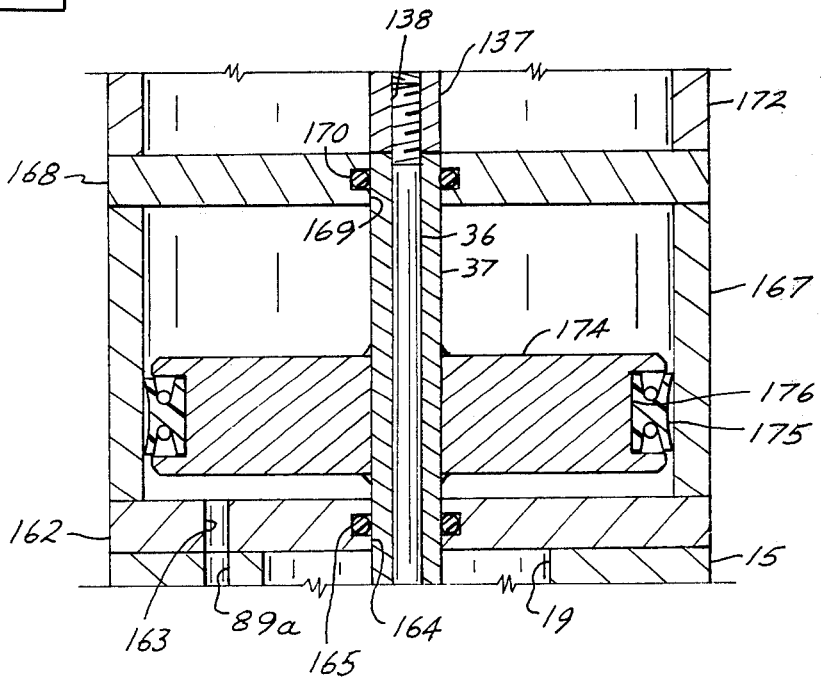

Referring now to FIG. 7, only the upper portion of body 15 is shown. A plate 162 corresponds to the squared shape of the upper surface of body 15, and is fitted flushly thereagainst. Plate 162 has a port 163 therethrough in register with port 89*a*. A central circular opening 164 has O-ring seal 165 in an annular groove therearound which slidably seals between plate 162 and sleeve 37. A cylindrical sleeve 167 is flushly and sealedly fitted at its lower edge against the upper surface of plate 162. Plate 168, which is like plate 162 except having no vertical passage therethrough, is fitted against the upper end of sleeve 167. Plate 168 has a circular opening 169 through which sleeve 37 is disposed and an O-ring seal 170 slidably seals around the sleeve. An upper sleeve 172 of cylindrical shape is engaged against the upper surface of plate 168, and above the portion thereof shown in FIG. 7 is like the upper portion of sleeve 121 of FIG. 5. Bar 137 having tapped opening 138 is screwed onto the upper end of shaft 36 as before.

A circular disc-shaped piston 174 is fixed around sleeve 37 by welding, or in other suitable manner. A seal 175 is disposed in an annular recess 176 around the periphery of piston 174 and seals between the piston and sleeve 167. When pressured air is supplied to the system for sandblasting operations, and when the deadman control valve is opened, pressurized air is supplied through passages 89*a*, 163 to beneath piston 174, which drives piston 174 upwardly to cause closing of the blowdown hose. Relief of the air pressure beneath the piston causes the piston to be moved downward, so that the blowdown hose is opened and valve 42 is closed. The operation of the embodiment of apparatus shown in FIG. 7 is, therefore, substantially identical with the operation of the earlier described embodiments.

Figure 8:
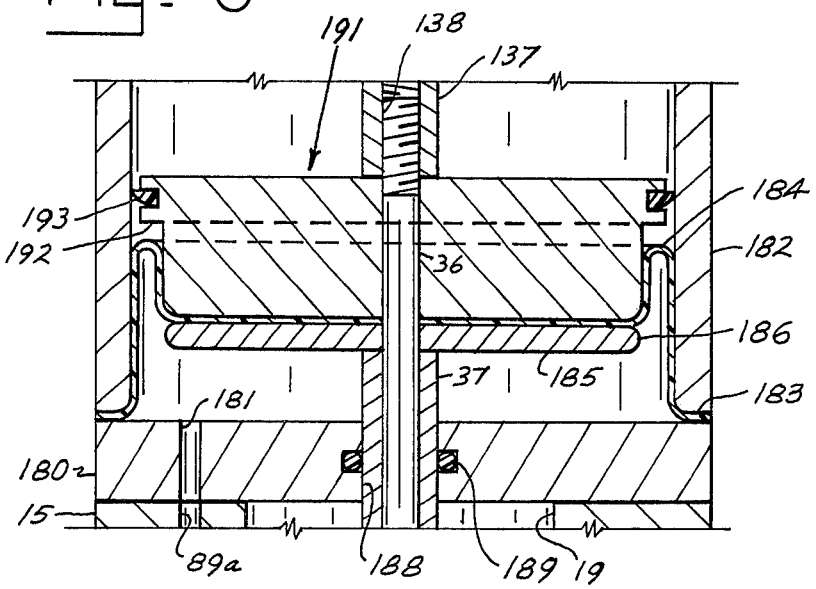

Another embodiment of apparatus is shown in FIG. 8 of the drawings. Again, only the upper portion of body 15 is shown. Plate 180 has passage 181 therethrough in communication with passage 89*a* and is of the same shape as the upper end of body 15, against which it is flushly disposed. Sleeve 182 is engaged against the edge 183 of a diaphragm 184, the diaphragm edge being clamped between the lower end of sleeve 182 and a circular annular portion of plate 180. Sleeve 182, at its portion above what is shown in FIG. 8 is identical with the upper portion of sleeve 121 of FIG. 5 of the drawings. In this embodiment of apparatus, sleeve 37 terminates below the upper end of shaft 36, the upper end of sleeve 37 being disposed against a circular plate 185 which has a curved outer edge 186.

Sleeve 37 is sealed through a central opening 188 through plate 180 by an O-ring seal 189. The central portion of diaphragm 184 is clamped between plate 185 and the lower surface of a body 191, the diaphragm and body 191 each having a central opening through which shaft 36 extends. Body 191 has annular flange 192 around its upper edge, and an annular recess therearound in which a lip seal 193 is disposed. Lip seal 193 prevents passage of sand falling upon the upper surface of body 191 from passing into the space occupied by the diaphragm.

Bar 137 having tapped opening 138 is screwed onto the upper end of shaft 36, and performs the blowdown hose closing function which has already been described. Pressured air entering through passages 89*a*, 181 to beneath plate 185 and the diaphragm causes upward movement of shaft 36 and sleeve 37 for function of the dual valve apparatus in the same manner as for the other embodiments which have previously been described.

Figure 9:
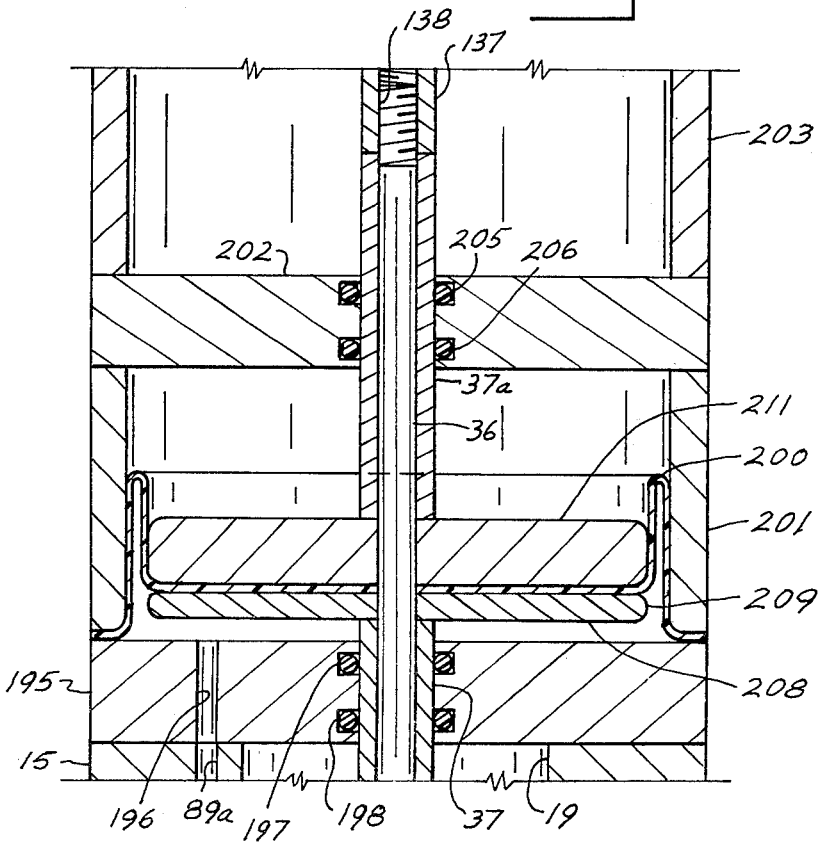

Yet another form of dual valve apparatus is shown in FIG. 9 of the drawings. Plate 195 is flushly fitted against the upper surface of body 15, and has passage 196 therethrough in communication with passage 89*a*. A pair of O-ring seals 197, 198 seal around sleeve 37, which is shorter than the sleeve 37 shown in others of the embodiments. Diaphragm 200 is clamped at its surrounding edge between sleeve 201 and the upper surface of plate 195. Squared plate 202 is flushly engaged against the upper end of sleeve 201, and a second sleeve 203 has its lower end flushly engaged against the upper surface of plate 202. A pair of O-ring seals 205, 206 slidably seal around sleeve 37*a* at a circular central opening through plate 202.

Circular plate 208 having rounded edge 209 is disposed against the upper end of sleeve 37, having a circular opening through which shaft 36 extends. Thicker plate 211 also has a central opening through which shaft 36 extends, and the central circular portion of diaphragm 200 is disposed around shaft 36 between plates 208 and 211. The diaphragm 200 is upwardly curved, as shown, between the outer edge of plate 211 and the inner surface of sleeve 201.

Bar 137, previously described, has tapped opening 138 screwed onto the upper end of shaft 36 to be disposed against the upper end of sleeve 37*a*. The upper portion of sleeve 203, not shown in FIG. 9, is identical with the upper portion of sleeve 121 of the FIG. 5 embodiment. When the sandblasting apparatus is pressured for operation, with air pressure being introduced through conduit 98, and the deadman control valve is operated, pressured air is introduced through passages 89*a*, 196 to beneath plate 208. The air pressure causes upward movement of plates 208, 211, with resulting upward movement of shaft 36 and sleeves 37, 37*a*. Upward movement of these elements causes closing of the blowdown hose by transverse bar 137, valve 42 being simultaneously opened, and downward movement of these elements resulting from depressurization caused by closing of the deadman control valve results in reopening of the blowdown hose and closing of valve 42.

It will be understood that insofar as operation of the sandblast apparatus is concerned, the differing valve forms perform in the same manner.

One feature of the invention shown in FIG. 5 of the drawings has not been described. A spring 215, shown as a helical compression spring, may be disposed between body 125 and valve 42 to bias valve 42 toward a closed position. Such a spring may be incorporated into any of the embodiments shown if a more positive closing bias for valve 42 and opening bias for the blowdown hose 86 is desired. The strength of spring 215 may be as desired for proper biasing of both of the valves.

The methods and apparatus of the invention represent substantial improvements in the art. Completely automatic operation of the blowdown valve is achieved, with fail-safe operation. Wear and failure of the blowdown valve is virtually completely eliminated. Necessity for use of screens or separators to protect the blowdown valve is eliminated.

While preferred embodiments of the methods and apparatus of the invention have been described and shown in the drawings, many modifications thereof may be made by a person skilled in the art without departing from the spirit of the invention, and it is intended to protect by Letters Patent all forms of the invention falling within the scope of the following claims.

We claim:

1. Sandblast control valve, comprising valve body means having a valve chamber therein, a fluid outlet passage through said body means from said chamber, a fluid inlet passage through said body means to said chamber, a valve seat around the inner end of said fluid outlet passage, first valve means within said chamber movable between a closed position against said seat and an opened position away from said seat, gas operated actuating means outside of said chamber for opening and closing said first valve means, and second valve means comprising elastomeric tube means extending through said body means which is pinched to close by said actuating means when said actuating means is moved to open said first valve means and which is released to open when said actuating means is moved to close said first valve means.

2. The combination of claim 1, said valve seat being circular and said first valve comprising circular disc means movable axially between said closed position against said seat and said opened position away from said seat.

3. The combination of claim 2, said disc means including elastomeric means for engaging said seat.

4. The combination of claim 1, including stem means connecting said first valve means to said actuating means extending sealedly and slidably through a wall of said body means at a side of said chamber.

5. The combination of claim 4, said actuating means comprising a diaphragm connected to said stem means and sealed to said body means around its periphery, said first valve means also being connected to said stem means, a first passage leading from the exterior of said body means to an enclosed space at one side of said diaphragm, a second passage leading from the exterior of said body means to said chamber.

6. The combination of claim 5, said body means including a first body having said chamber therein, and a first plate sealedly disposed at one side against one side of said first body closing one end of said chamber, and a tubular body having one end thereof sealedly disposed against the other side of said first plate, and a second plate disposed against the other end of said tubular body, and connection means holding said first body and said tubular body and said first and second plates together.

7. The combination of claim 6, said diaphragm being clamped at its outer surrounding edge between said first plate and said one end of said tubular body.

8. The combination of claim 6, said first plate having a concentric reduced portion at its side away from said chamber, a cup-shaped member fixed to said shaft and its sidewall being uniformly spaced around said reduced portion, said diaphragm being fixed to the end of said reduced portion around its center and its surrounding peripheral edge being fixed around the interior of said sidewall of said cup-shaped member.

9. The combination of claim 6, including a first bar fixed transversely across said one end of said stem means at the side of said diaphragm toward said tubular body, a second bar fixed across the inner side of said second plate and being parallely spaced from said first bar, said tubular body having openings through opposite sides of its surrounding wall each substantially equally spaced between the opposite ends of each of said first and second bars, and said elastomeric tube means being disposed through said openings transversely between said first and second bars.

10. The combination of claim 9, said diaphragm being circular and having a flat circular central portion having circular plate means at opposite sides thereof and having an annular portion outwardly thereof inwardly of its peripheral edge portion permitting movement of said central portion axially of said edge portion.

11. The combination of claim 10, said circular plate means at the side of said diaphragm outside of said enclosed space having wiper means therearound slidably and sealedly engaging said tubular body to prevent ingress of particulate matter onto said diaphragm.

12. The combination of claim 1, including a pressure vessel adapted to contain particulate abrasive and including means for draining abrasive therefrom into a sandblast hose, a first conduit leading from a pressured gas supply to said fluid inlet passage, a second conduit leading from said fluid outlet passage to said sandblast hose, said actuating means including a gas inlet connection, a third conduit including a control valve in series therein leading from said pressured gas supply to said gas inlet connection, a fourth conduit leading from said second conduit to the interior of said pressure vessel, said control valve when opened admitting pressured gas to said actuating means to open said first valve means whereby pressured gas flows into said sandblast hose and into said pressure vessel and to close said second valve means whereby pressured gas is retained within said pressure vessel, said control valve when closed venting pressured gas from said actuating means to close said first valve means and to open said second valve means whereby pressured gas is exhausted from within said pressure vessel through said hose.

13. The combination of claim 12, said control valve being biased to close when released whereby said first valve means is automatically closed and said second valve is automatically opened when said control valve is released, whereby said apparatus is fail-safe.

14. The combination of claim 4, including a pressure vessel adapted to contain particulate abrasive and including means for draining abrasive therefrom into a sandblast hose, a first conduit leading from a pressured gas supply to said fluid inlet passage, a second conduit leading from said fluid outlet passage to said sandblast hose, said actuating means including a gas inlet connection, a third conduit including a control valve in series therein leading from said pressured gas supply to said gas inlet connection, a fourth conduit leading from said second conduit to the interior of said pressure vessel, said control valve when opened admitting pressured gas to said actuating means to open said first valve means whereby pressured gas flows into said sandblast hose and into said pressure vessel and to close said second valve means whereby pressured gas is retained within said pressure vessel, said control valve when closed venting pressured gas from said actuating means to close said first valve means and to open said second valve means whereby pressured gas is exhausted from within said pressure vessel through said hose.

15. The combination of claim 14, said control valve being biased to close when released whereby said first valve means is automatically closed and said second valve is automatically opened when said control valve is released, whereby said apparatus is fail-safe.

16. The combination of claim 6, including a pressure vessel adapted to contain particulate abrasive and including means for draining abrasive therefrom into a sandblast hose, a first conduit leading from a pressured gas supply to said fluid inlet passage, a second conduit leading from said fluid outlet passage to said sandblast hose, a third conduit including a control valve in series therein leading from said first passage to said second passage, a fourth conduit leading from said conduit to the interior of said pressure vessel, said control valve when opened admitting pressured gas to said enclosed space at one side of said diaphragm to open said first valve means whereby pressured gas flows into said sandblast hose and into said pressure vessel, said control valve when closed venting pressured gas from said enclosed space at one side of said diaphragm to close said first valve means and to open said valve means whereby pressured gas is exhausted from within said pressure vessel through said hose.

17. The combination of claim 16, said control valve being biased to close when released whereby said first valve means is automatically closed and said second valve is automatically opened when said control valve is released, whereby said apparatus is fail-safe.

18. The combination of claim 10, including a pressure vessel adapted to contain particulate abrasive and including means for draining abrasive therefrom into a sandblast hose, a first conduit leading from a pressured gas supply to said fluid inlet passage, a second conduit leading from said fluid outlet passage to said sandblast hose, a third conduit including a control valve in series therein leading from said first passage to said second passage, a fourth conduit leading from said second conduit to the interior of said pressure vessel, said control valve when opened admitting pressured gas to said enclosed space at one side of said diaphragm to open said first valve means whereby pressured gas flows into said sandblast hose and into said pressure vessel, said control valve when closed venting pressured gas from said enclosed space at one side of said diaphragm to close said first valve means and to open said second valve means whereby pressured gas is exhausted from within said pressure vessel through said hose.

19. The combination of claim 18, said control valve being biased to close when released whereby said first valve means is automatically closed and said second valve is automatically opened when said control valve is released, whereby said apparatus is fail-safe.

20. The combination of claim 4, said actuating means comprising a piston connected to said stem means and slidably sealed to said body means around its periphery, said first valve means also being connected to said stem means, a first passage leading from the exterior of said body means to an enclosed space at one side of said piston, a second passage leading from the exterior of said body means to said chamber.

21. The combination of claim 20, said body means including a first body having said chamber therein, and a first plate sealedly disposed at one side against one side of said first body closing one end of said chamber, and a tubular body having one end thereof sealedly disposed against the other side of said first plate, and a second plate disposed against the other end of said tubular body, and connection means holding said first body and said tubular body and said first and second plates together.

22. The combination of claim 21, said first plate having a concentric reduced portion at its side away from said chamber, said piston being cup-shaped and having its sidewall portion slidably sealed around its periphery to the side of said reduced portion.

23. The combination of claim 21, including a first bar fixed transversely across said one end of said stem means at the side of said piston toward said tubular body, a second bar fixed across the inner side of said second plate and being parallely spaced from said first bar, said tubular body having openings through opposite sides of its surrounding wall each substantially equally spaced between the opposite ends of each of said first and second bars, and said elastomeric tube means being disposed through said openings transversely between said first and second bars.

24. The combination of claim 21, said piston being slidably sealed around its periphery with the interior of said tubular body.

25. The combination of claim 24, said tubular body comprising two aligned tubular portions having a transverse plate therebetween engaging the full peripheries of said tubular portions, said transverse plate having said stem means slidably and sealedly disposed through an opening therethrough.

26. The combination of claim 21, including a pressure vessel adapted to contain particulate abrasive and including means for draining abrasive therefrom into a sandblast hose, a first conduit leading from a pressured gas supply to said fluid inlet passage, a second conduit leading from said fluid outlet passage to said sandblast hose, a third conduit including a control valve in series therein leading from said first passage to said second passage, a fourth conduit leading from said second conduit to the interior of said pressure vessel, said control valve when opened admitting pressured gas to said enclosed space at one side of said piston to open said first valve means whereby pressured gas flows into said sandblast hose and into said pressure vessel, said control valve when closed venting pressured gas from said enclosed space at one side of said piston to close said first valve means and to open said second valve means whereby pressured gas is exhausted from within said pressure vessel through said hose.

27. The combination of claim 1, said control valve being biased to close when released whereby said first valve means is automatically closed and said second valve is automatically opened when said control valve is released, whereby said apparatus is fail-safe.

28. The combination of claim 23, including a pressure vessel adapted to contain particulate abrasive and including means for draining abrasive therefrom into a sandblast hose, a first conduit leading from a pressured gas supply to said fluid inlet passage, a second conduit leading from said fluid outlet passage to said sandblast hose, a third conduit including a control valve in series therein leading from said first passage to said second passage, a fourth conduit leading from said second conduit to the interior of said pressure vessel, said control valve when opened admitting pressured gas to said enclosed space at one side of said piston to open said first valve means whereby pressured gas flows into said sandblast hose and into said pressure vessel, said control valve when closed venting pressured gas from said enclosed space at one side of said piston to close said first valve means and to open said second valve means whereby pressured gas is exhausted from within said pressure vessel through said hose.

29. The combination of claim 28, said control valve being biased to close when released whereby said first valve means is automatically closed and said second valve is automatically opened when said control valve is released, whereby said apparatus is fail-safe.

30. Method for operating a sandblasting apparatus having a pressure vessel for containing particulate abrasive and means for draining abrasive from said vessel into a pressured gas stream flowing through said sandblast hose, and having a pressured gas supply leading to a gas control valve from which pressured gas flows into said vessel and into said sandblast hose, and having a blowdown exit from said vessel, comprising connecting a guillotine valve to said gas control valve to be closed by movement of said gas control valve to opened position and to be opened when said gas control valve is moved to closed position, and connecting the hose of said quillotine valve to said blowdown exit from said vessel, whereby gas pressure is retained within said vessel whenever said gas control valve is opened and whereby gas pressure is released from within said vessel whenever said gas control valve is closed.

31. Method according to claim 30, including operating said gas control valve to open by gas pressure from said pressured gas supply and operating said gas control valve to close by the resilient opening of said guillotine valve.

32. Method according to claim 30 or 31, wherein said pressured gas is pressured air.

33. Method according to claim 30 or 31, including operating said gas control valve to open by gas pressure applied against a diaphragm.

34. Method according to claim 30 or 31, including operating said gas control valve to open by gas pressure applied against a piston.

* * * * *